US007654625B2

(12) United States Patent
Amann et al.

(10) Patent No.: US 7,654,625 B2
(45) Date of Patent: Feb. 2, 2010

(54) PULL-OUT GUIDE FOR DRAWERS

(75) Inventors: Juergen Amann, Lustenau (AT); Markus Albrecht, Lustenau (AT); Wolfgang Mueller, Lustenau (AT); Holger Wenzel, Lindau (DE)

(73) Assignee: Grass GmbH, Höchst (AT)

( * ) Notice: Subject to any disclaimer, the term of this patent is extended or adjusted under 35 U.S.C. 154(b) by 161 days.

(21) Appl. No.: 10/858,609

(22) Filed: Jun. 2, 2004

(65) Prior Publication Data

US 2004/0245898 A1 Dec. 9, 2004

(30) Foreign Application Priority Data

Jun. 5, 2003 (EP) ..... 03012770

(51) Int. Cl.
*A47B 88/00* (2006.01)

(52) U.S. Cl. ..... 312/334.44; 312/333; 312/334.1

(58) Field of Classification Search ..... 312/333, 312/334.44, 334.45, 334.46, 334.47, 330.1, 312/348.1, 348.2, 348.4, 334.1, 34.6, 334.7, 312/334.5, 334.14, 334.27, 334.31; 384/21
See application file for complete search history.

(56) References Cited

U.S. PATENT DOCUMENTS

| | | | | |
|---|---|---|---|---|
| 4,810,045 | A * | 3/1989 | Lautenschlager | 312/334.5 |
| 5,458,413 | A | 10/1995 | Huber et al. | |
| 5,580,139 | A * | 12/1996 | Grabher | 312/333 |
| 5,632,541 | A | 5/1997 | Uthoff | |
| 6,412,893 | B1 * | 7/2002 | Muterthies et al. | 312/348.1 |
| 6,601,933 | B1 * | 8/2003 | Greenwald | 312/333 |
| 6,629,738 | B2 * | 10/2003 | Salice | 312/333 |
| 6,736,471 | B2 * | 5/2004 | Lin | 312/333 |
| 6,953,233 | B2 * | 10/2005 | Lam et al. | 312/333 |
| 6,979,065 | B2 * | 12/2005 | Egger | 312/333 |
| 7,108,339 | B2 * | 9/2006 | Berger | 312/333 |
| 2001/0019235 | A1 | 9/2001 | Hammerle | |
| 2004/0212283 | A1 * | 10/2004 | Gasser | 312/333 |

FOREIGN PATENT DOCUMENTS

| | | | |
|---|---|---|---|
| DE | 3347540 | * | 7/1985 |
| DE | 9204845 | | 7/1992 |
| DE | 4114708 | A1 | 11/1992 |
| DE | 93 10 582 | | 11/1993 |
| DE | 9402042 | | 5/1994 |
| DE | 9416504 | | 11/1994 |
| DE | 295 21 412 | U1 | 4/1997 |
| DE | 198 28 718 | A1 | 12/1999 |
| DE | 299 14 431 | U1 | 3/2000 |
| DE | 199 44 639 | A1 | 3/2001 |
| EP | 0421458 | B1 | 9/1993 |
| EP | 0 660 681 | B1 | 1/1997 |
| EP | 0 695 523 | B1 | 2/1998 |
| EP | 0702916 81 | | 4/2003 |
| WO | WO 2005/001 299 | A2 | 1/2005 |

* cited by examiner

*Primary Examiner*—Hanh V Tran
(74) *Attorney, Agent, or Firm*—Kilpatrick Stockton LLP

(57) ABSTRACT

A pull-out slide for drawers, in particular cabinet drawers, with opposing drawer side walls and with or without decoration components has drawer rails that are fastened on the drawer and cabinet rails that are fastened on the cabinet body and a device configured to cooperate with each drawer rail and each cabinet rail to enable a pull-out function of the drawer. A function carrier located at or near the front end of each drawer rail has one or more function elements for taking up, holding and/or connecting parts of the drawer and/or one or more function elements for readying, supporting and/or completing drawer functions.

24 Claims, 11 Drawing Sheets

Fig. 2
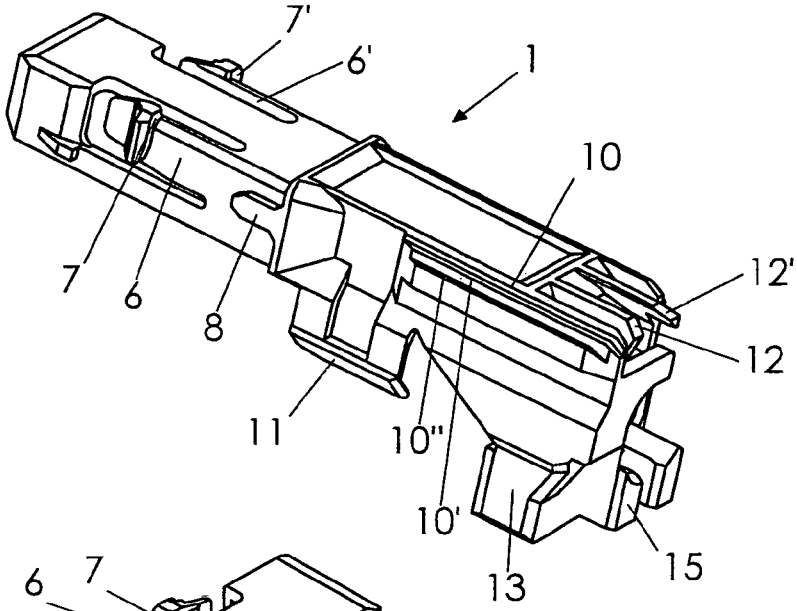
Fig. 3
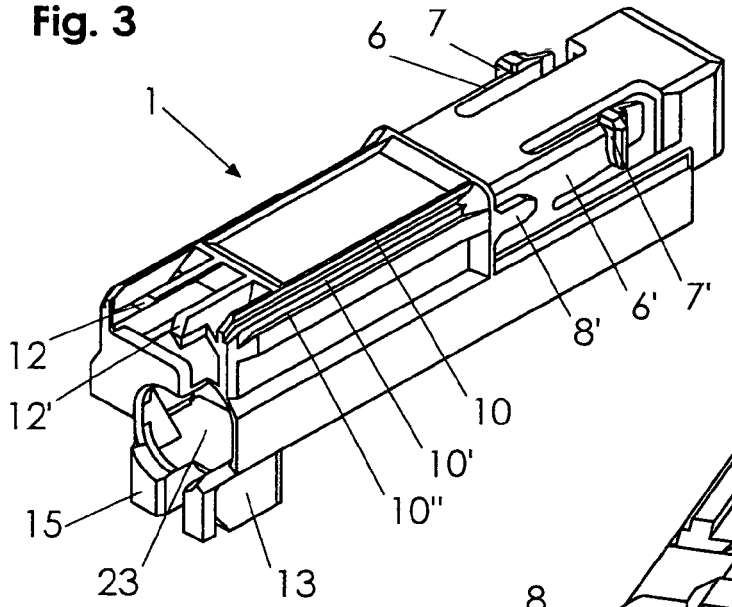
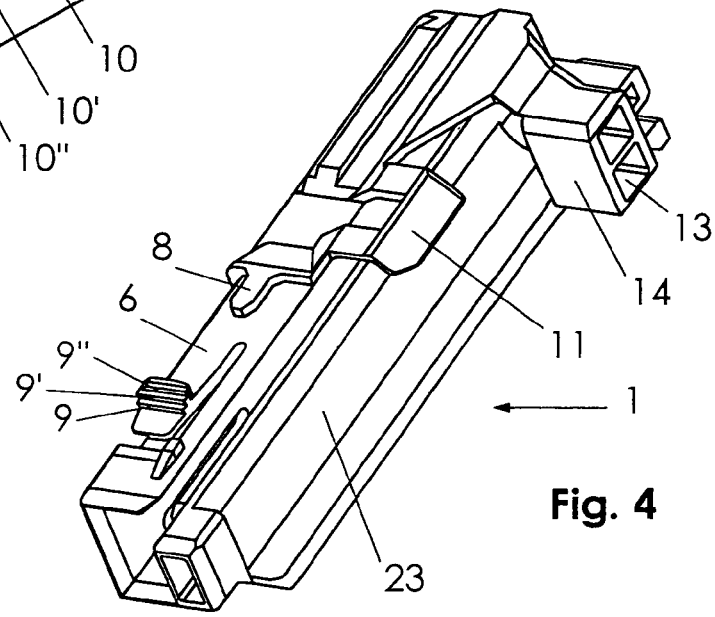
Fig. 4

Fig. 5
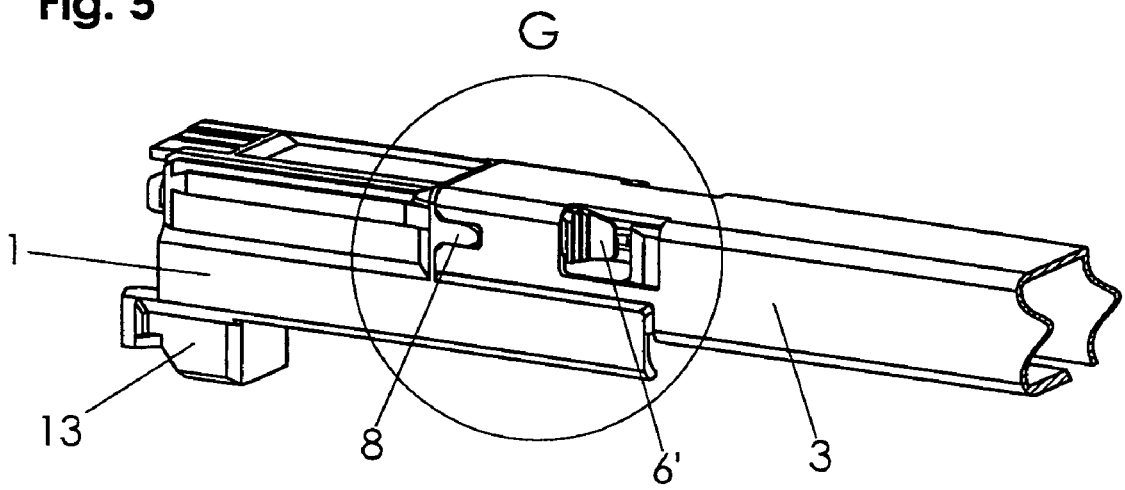
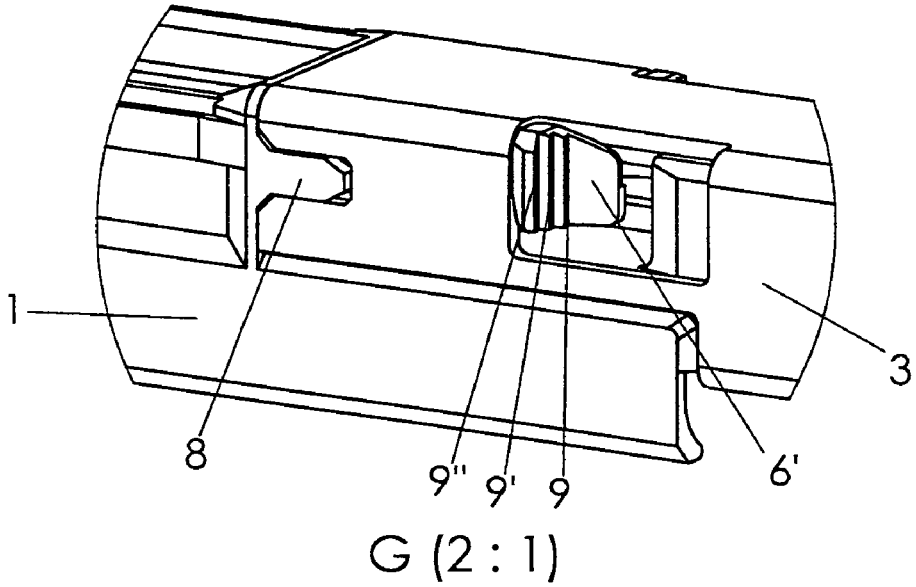
Fig. 6
Fig. 7
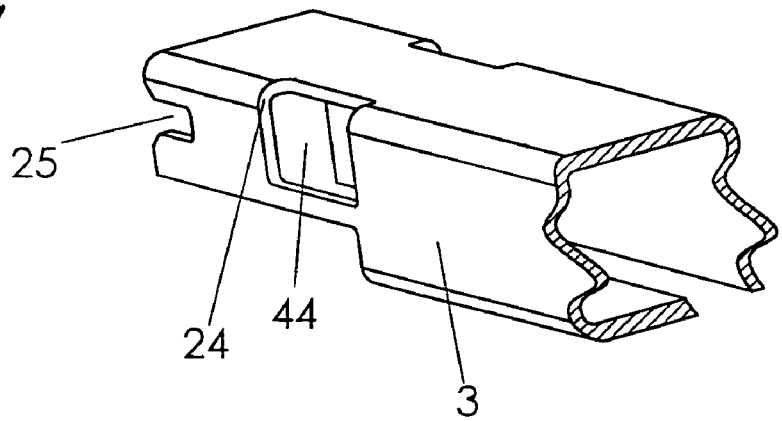

Fig. 8
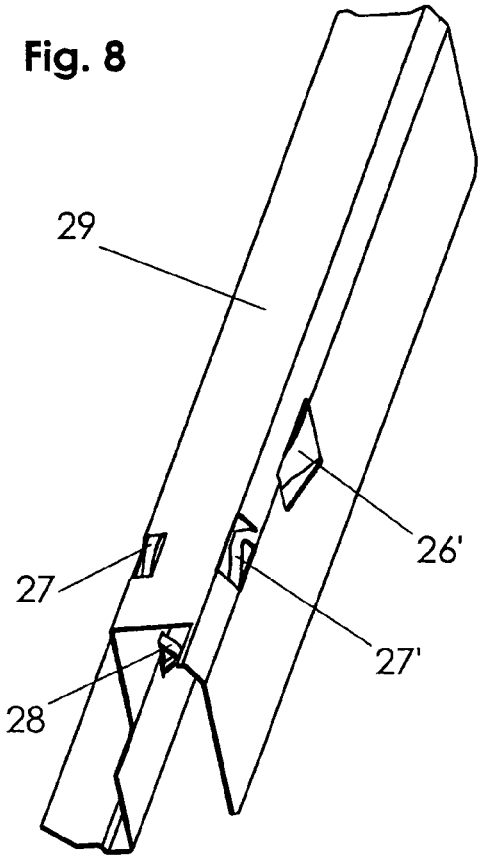
Fig. 9
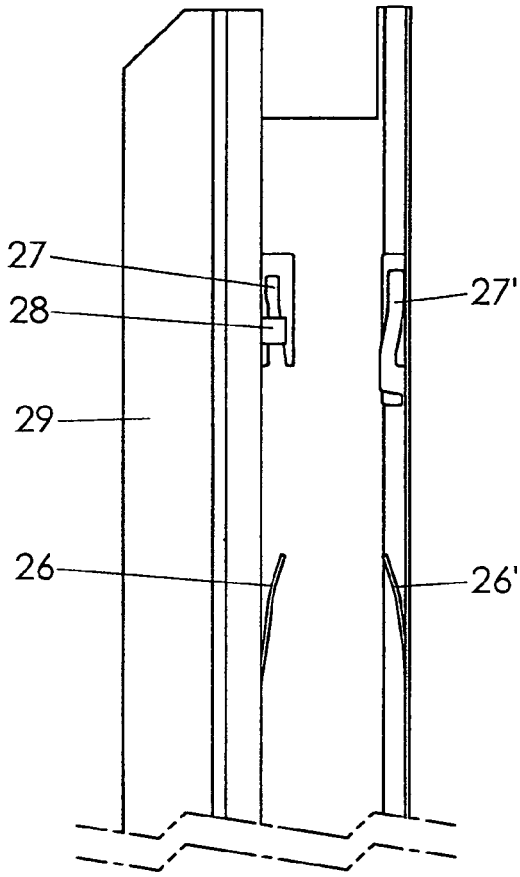
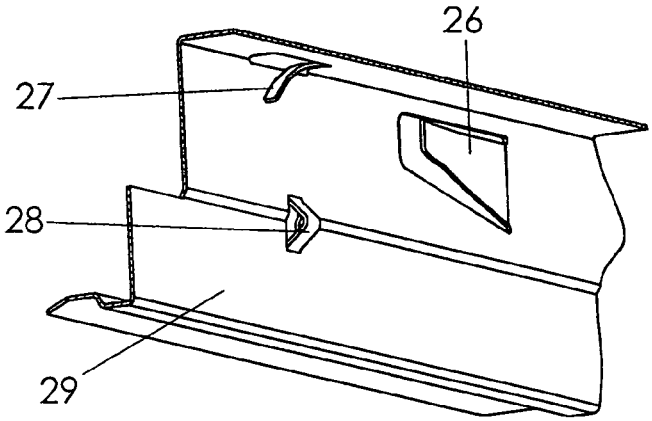
Fig. 10

Fig. 22
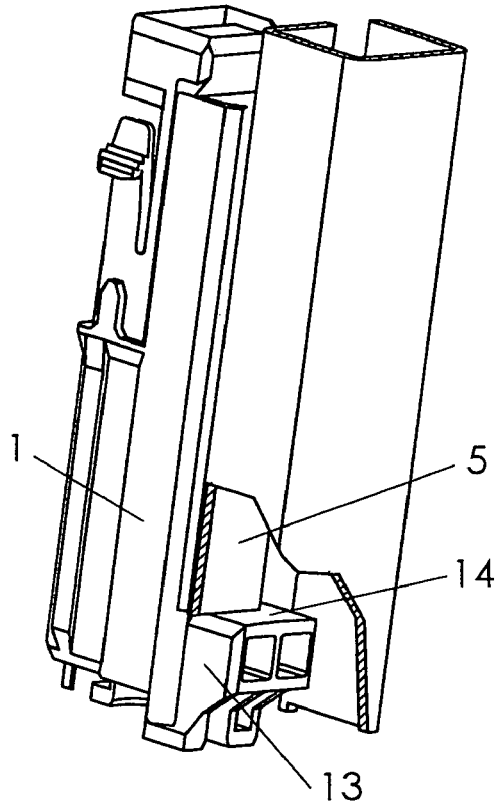
Fig. 23
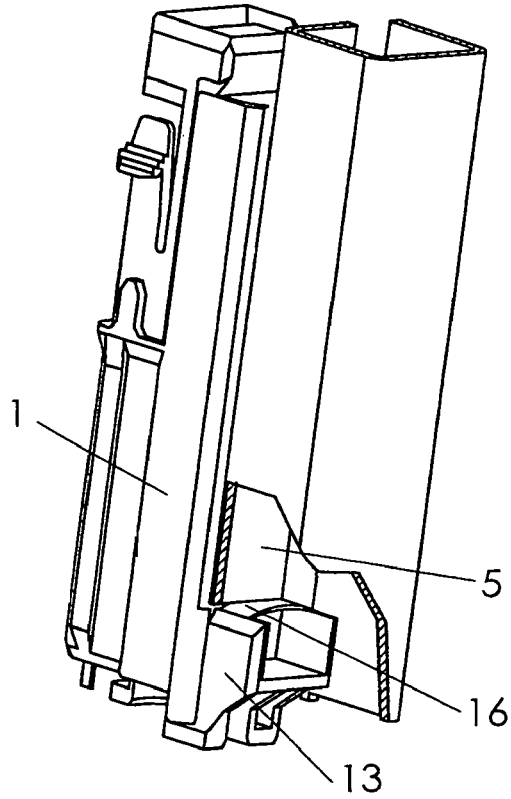
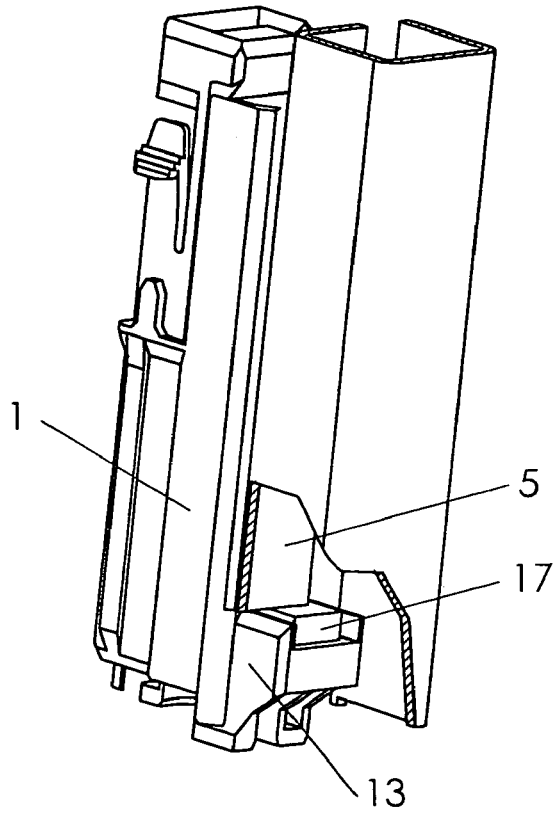
Fig. 24

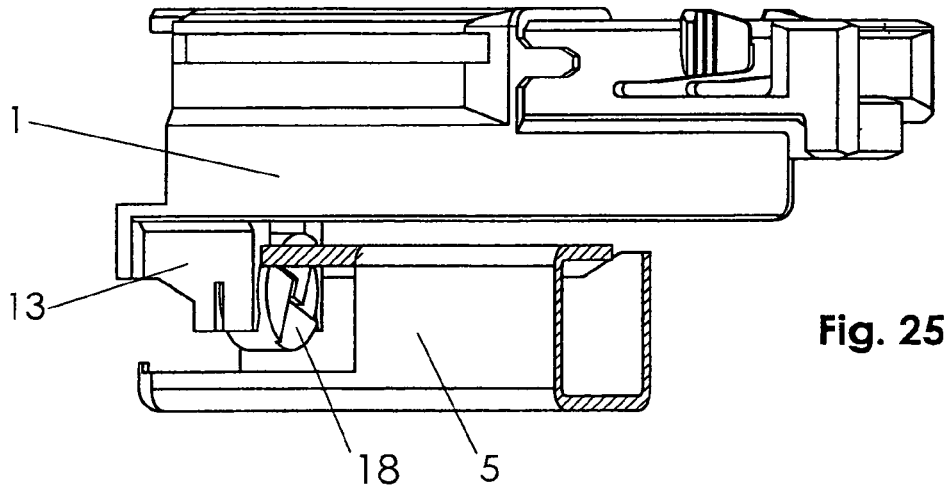
Fig. 25
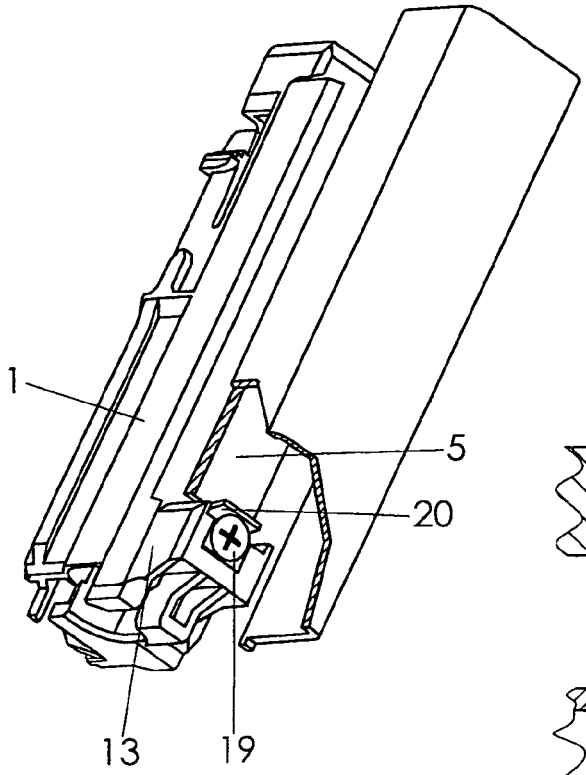
Fig. 26
Fig. 27
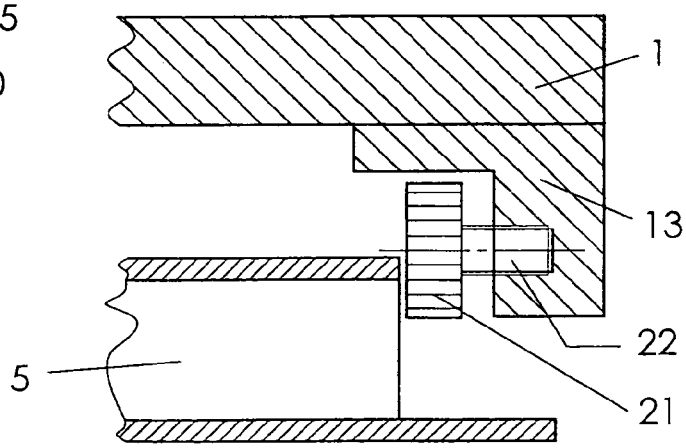

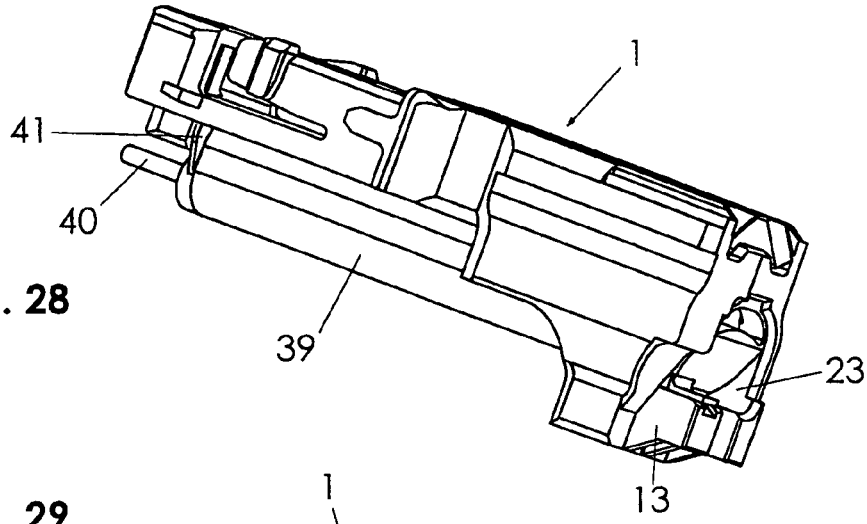
Fig. 28
Fig. 29
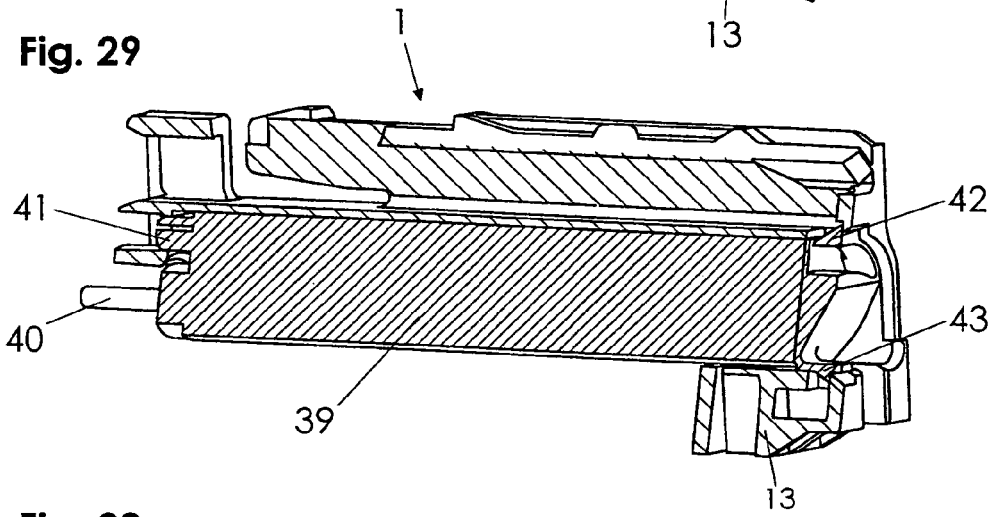
Fig. 30
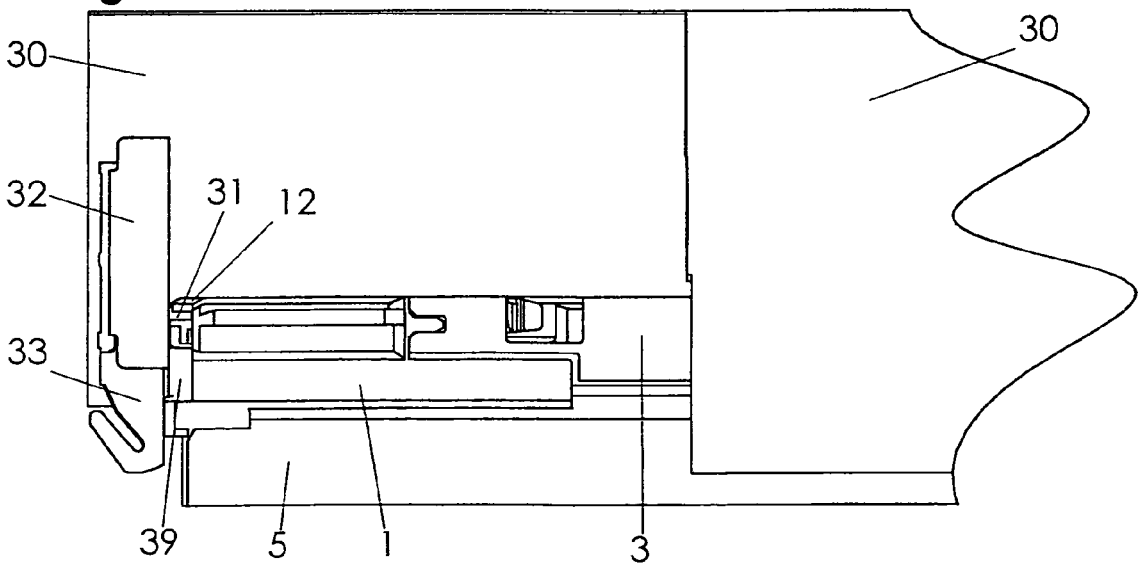

PULL-OUT GUIDE FOR DRAWERS

FIELD OF THE INVENTION

The invention concerns a pull-out slide for drawers, especially for cabinet/furniture drawers, according to the characterizing clause of the independent claims.

BACKGROUND OF THE INVENTION

In the current state of technology, pull-out slides for cabinet drawers are known, which are installed in the drawer's side walls. Also well known in regard to pull-out slides are mechanisms with various functions, such as a side adjusting function, a fail-safe function (which prevent the drawer from falling out unintentionally), a lift-up function, an end-stop function, a self-closing or a damping/absorbing function.

The disadvantage of this current state of technology is that these devices and/or functions with complicated mechanics are integrated and/or attached and can often be installed, adjusted and/or exchanged only with difficulty. In addition, each function must be manufactured and installed separately and requires many manufacturing steps.

It is, therefore, the task of the present invention to create a pull-out slide for drawers, which makes the integration and/or attachment of additional devices and/or functions simpler and easier, and which reduces the manufacturing costs and improves the subsequent use of the cabinet drawer.

SUMMARY OF THE INVENTION

According to the invention, the pull-out slide includes within the drawer front area in a respective part of the drawer rail a function carrier, which has at least one functional element to take up, hold and/or connect the components of the drawer and/or at least one functional element to ready, support and/or complete the drawer functions.

One such available function carrier on the pull-out slide can serve as a device to insert and/or take out a cabinet drawer from the pull-out slide with or without decoration.

Additional embodiments and systems and preferred developments of the invention are given in the dependent patent claims.

In a preferred embodiment, the function carrier is arranged with one of the drawer rail's adapted cross sections in the drawer rail or in the length of the drawer rail and is connected, releasable or fixed (non-releasable), with it. Preferably, the function carrier is formed attachable and detachable on the drawer rail. In order to attain a better positioning of the function carrier, the function carrier can even have the drawer rail's positioning elements also, that engage into one another when the function carrier is attached on the drawer rail.

According to the invention, the function carrier is also not designed as a separate part connected with the drawer rail, but instead as an integral component of the drawer rail.

Putting in or taking out the function carrier in the drawer rail takes place by pushing in and/or pulling out the function carrier in the drawer rail; whereby, the springy latches make this installment and removal possible. For this, at least one elastic springy latch is formed on the function carrier, which engages in a corresponding opening of the drawer rail. The springy latch has for this purpose, preferably, a step, that can be engaged on an edge of the drawer rail's opening. Accordingly, a loosening of the function carrier from the drawer rail results when the springy latches are operated laterally and/or from top to bottom and remove the function carrier from the drawer rail.

Another function of the function carrier is that that function carrier has one or more devices for the releasable connection of the pull-out slide with the drawer side wall and/or the decoration.

Preferably there is a side centering for tolerance equalization available in the function carrier, so that the pull-out slide can be positioned within the width of the decoration. For this, the function carrier includes one or more bearing surfaces on which springy latches fit on the decorations; whereby, the springy latches engage on one or both sides of the function carrier and lock the decoration. In this way, a longitudinal fastening of the decoration on the function carrier is guaranteed.

The bearing surfaces can be formed, preferably, in the shape of steps, so that the decoration can be secured in the lengthwise direction of the pull-out slide resulting in various catch positions for the decoration's springy latches.

Preferably, a blocking of the side centering for tolerance equalization in the function carrier is also provided, in order to make a secure locking of the previously centered pull-out slide inside the decoration possible. In addition, according to the invention, an edge is formed on a lateral edge running along the function carrier, which engages with springy detent grip claws attached on the decoration.

The edge can be formed in the shape of steps, resulting in various catch positions for the detent grip claws to fix the decoration in a cross-wise direction of the pull-out slide.

According to an additional design of the invention, the function carrier has a fail-safe function so that a nose of the decoration is supported on a springy tab of the function carrier, which can move only a little when the pull-out slide is in a closed position, because it is blocked from the center rail. So the drawer cannot disengage itself if it is put in an upside position (when shipping, for example). When the pull-out slide is in the open position, the tabs release and can fit with the springs because the center rail doesn't lie behind it anymore. In this case, the drawer can be removed from the drawer rail.

Preferably, another function of the function carrier is provided for the drawer's disengagement. One or more fingers engage with the drawer's side wall's connected part into a springy tab of the function carrier. By lifting the whole drawer, the finger releases from the springy tab and the drawer from the drawer rail. Removing the drawer by lifting it is only possible if the pull-out slide is pulled out because otherwise the fail-safe function (that prevents the drawer from falling out) that is described above, keeps the drawer from being lifted.

In another design, the pull-out slide has an end stop that is attached to the underside of the function carrier and meets with a stop surface directly on the cabinet rail. Preferably, a front surface of the end stop is supported on the front fastening device of the drawer.

The stop surface of the end stop can be made flexible/elastic or can include an inserted or attached flexible/elastic piece.

According to another design of the invention, the stop surface can be located at or on an adjustable element. Depending on the design, the adjustable element can be formed as multi-level on the function carrier's respective wheel, as an adjusting screw working on a springy tongue of the stop surface or as a knurled thumb screw.

Opposite the stop surface, a front surface of the end stop supports itself, preferably, directly on the decoration parts and/or the front fastening device.

A further operational characteristic consists of the fact that a holding device for a damping element and/or an automatic self-closing device is provided on the function carrier.

It is also possible that the function carrier has a hollow space in which the damping element and/or the automatic self-closing device is provided.

In order to keep the damping element and/or the automatic self-closing device securely in the planned position, it is engaged on the function carrier and/or in the hollow space, for example, by means of a catch connection. Preferably, the damping element and/or the automatic self-closing device is place in such a way that its bottom is supported on parts of the drawer side wall.

The invention-related function carrier for drawer pull-out slides, especially for a cabinet drawer with drawer slide wall with or without decoration, is characterized by the fact that it is located in the area of the drawer front's respective parts of the drawer rail and at least one function element for the reception, holding and/or connection or drawer parts and/or at least one function element to ready, support and/or complete the drawer functions.

The decoration itself has a springy latch on the side surface for lateral centering, that works together with corresponding bearing surfaces of the drawer rail or one of the function carriers provided on the drawer rail.

Additionally, springy detent grip claws are provided in the upper area that are supported on corresponding edges of the drawer rail or on one of the drawer rail's available function carriers. Furthermore, the decoration has a nose, which is supported on a springy tab of the drawer rail or on one of the drawer rail's available function carriers, and, therefore, prevents the drawer from detaching when the cabinet is placed or stored upside down.

The following drawings more closely describe various designs and embodiments of the invention, which are, however, only here as examples and are not to be understood as limiting.

BRIEF DESCRIPTION OF THE DRAWINGS

FIG. 2: a perspective view of a function carrier for a pull-out slide in which the functions of the left, upper and front sides are visible;

FIG. 3: a perspective view of a function carrier for a pull-out slide, in which the functions of the right, upper and front sides are visible;

FIG. 4: a perspective view of a function carrier for a pull-out slide in which the left, lower and back sides are visible;

FIG. 5: a perspective view of a function carrier for a pull-out slide; whereby, the function carrier is inserted in the front of the drawer rail;

FIG. 6: a detailed view of FIG. 5 in the area of the connecting device between the drawer rail and the function carrier;

FIG. 7: a perspective view of the front-sided end of the drawer rail of a pull-out slide, in whose area the function carrier is fastened;

FIG. 8: a perspective view of an embodiment example of the decoration for a pull-out slide, which shows the functions complementary to the function carrier;

FIG. 9: a view of the decoration from below, which shows the functions complementary to the function carrier;

FIG. 10: a section cut through the decoration of the pull-out slide, which shows the function complementary to the function carrier;

FIG. 22: a perspective view of a first embodiment example of an end stop of the function carrier, which shows only the function carrier and the cabinet rail;

FIG. 23: a perspective view of a second embodiment example of an end stop of the function carrier, which shows only the function carrier and the cabinet rail;

FIG. 24: a perspective view of a third embodiment example of an end stop of the function carrier, which shows only the function carrier and the cabinet rail;

FIG. 25: a perspective view of a first embodiment example of an adjustable end stop of the function carrier, which shows only the function carrier and the cabinet rail;

FIG. 26: a perspective view of a second embodiment example of an adjustable end stop of the function carrier, which shows only the function carrier and the cabinet rail;

FIG. 27: a sketched view of a third embodiment example of an adjustable end stop of the function carrier, which shows only the function carrier and the cabinet rail;

FIG. 28: a perspective view of the function carrier with a damping element mounted to it;

FIG. 29: a section cut through the function carrier with a mounted damping element;

FIG. 30: a side view, partly cut, of an embodiment example of a function carrier for pull-out slides, which show the function carrier in the pull-out slide together with a mounted damping element.

DETAILED DESCRIPTION

Figure 1:
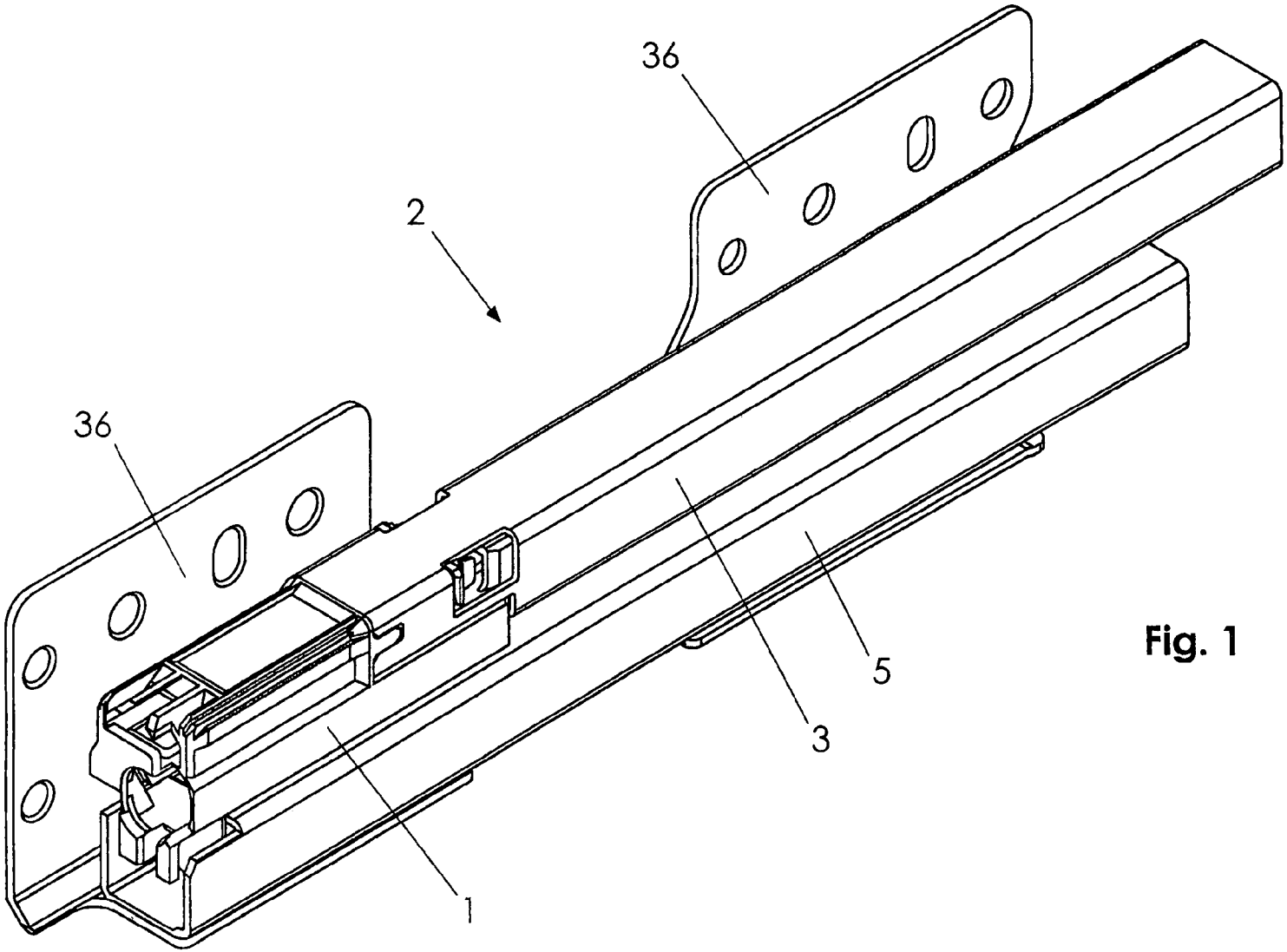
FIG. 1: an isometric view of a pull-out slide in which the function carrier is installed in the pull-out slide.

FIG. 1 shows a perspective view of an embodiment of the invention-related pull-out slide (2). The pull-out slide (2) includes a well-known way a so-called drawer rail (3), which is connected with a drawer (not shown) and/or a part of this. Furthermore, the pull-out slide (2) includes a so-called cabinet rail (5), which is fastened, for example, by means of a cabinet adaptor (36) to a cabinet body (not shown). Between the cabinet rail (5) and the drawer rail (3), there is usually a movably connected center rail (4), which is not shown in FIG. 1. Now, according to the invention, a function carrier (1) is located in the respective parts of the drawer rail (3) in the area of the drawer front. The function carrier (1) includes at least one function element to take up, hold and/or connect parts of the drawer and/or at least one function element to ready, support and/or complete drawer functions. The function carrier (1) can, as is shown in FIG. 1, be a separate part; preferably, made as a plastic part, which is connected releasable or fixed to the drawer rail (3). The function carrier (1) can, however, also be an integral component of the drawer rail (3) and be connected as one piece with it.

FIGS. 2, 3 and 4 show various size views of the function carrier (1). The function carrier (1) has one of the adapted cross sections of the drawer rail (3) and is attached to the length of the drawer rail (3) and is engaged in the drawer rail (3). The catch function takes place by means of lateral springy latches (6, 6') in connection with a step (7, 7'), which will be described later. Somewhat in the longitudinal center, the function carrier (1) has a centering and/or positioning element (8) that engages in the respective recess of the drawer rail (3) and the function carrier (1) positions in it. Also, that will be described more closely later.

The springy latches (6, 6') have on each of their outer ends a row of step-shaped bearing surfaces (9, 9', 9"). At the top, the springy latches (6, 6') located on somewhat opposite part of the function carrier (1) are in each case lateral edges in step-shaped design (10, 10', 10"). Preferably, on one side there is a springy tab (11) between the springy latch (6) and the edge (10). On the front side of the drawer front (38), the corresponding end of the function carrier (1) has additionally two springy tabs (12, 12'), which, among other things, serve to connect the drawer with the drawer rail (3) and/or with the function carrier (1). In the lower area of the function carrier (1), an end stop (13) is provided that works together with a bearing surface of the cabinet rail (5) and limits the insertion of the pull-out slide (2).

The end stop (13) has an actual stop surface (14) on the respective side of the drawer front (38), which meets on the cabinet rail (5), and a front surface (15) on the respective side of the drawer front (38), which is supported on parts of the decoration and/or the front fastening device (33) of the drawer, as is described further below. Furthermore, a hollow space (23) is located inside the function carrier (1), which serves to take up various devices for readying drawer functions, such as for example, a damping device or an automatic self-closing device.

FIGS. 5, 6 and 7 show the type of the attachment of the function carrier (1) on the drawer rail (3). FIG. 7 shows a perspective view of the front-sided end of the drawer rail (3) of the pull-out slide (2), in which area the function carrier (1) is fastened. The drawer rail (3) is in this example, designed as a rectangular tube, which is open on the front side and has a slot (25) on the left and right side. In respective distance to the slot (25), there are always also openings (44) on the left and right, which form a catch edge (24) on the front end.

FIG. 5 and especially the enlarged representation according to FIG. 6, show a mounted function carrier (1) on the drawer rail (3). The function carrier (1) is inserted with its end stop's (13) opposite end in the tube of the drawer rail (3) so that the positioning element (8) of the function carrier (1) engages in the slot (25) of the drawer rail (3). At the same time the springy latches (6 and 6') slide along the inside of the drawer rail (3) and always engage at the catch edge (24) of the opening (44). Thus, the function carrier (1) is securely connected to the drawer rail (3). The opening (44) is designed large enough so that the step-shaped bearing surfaces (9, 9' and 9") remain freely accessible. The step-shaped bearing surfaces, among other things, fasten the so-called decoration (29) on the drawer rail (3).

Such a decoration (29) is shown in FIGS. 8 to 10 and covers the drawer side walls (30). The decoration (29) in this example is designed somewhat U-shaped; whereby, the closed end of the U forms the upper side and the open end of the U forms the lower side, into which the pull-out slide (2) is inserted. The decoration (29) includes various functional elements that work together with respective functional elements of the function carrier (1). There are lateral springy latches (26, 26') located on the front-lateral part of the decoration (29) that are positioned in such a way that they work together with the step-shaped bearing surfaces (9, 9', 9"). Further front in respective distance to the latches (26 and 26'), two detent grip claws (27, 27') are formed from the material of the decoration (29) and are positioned in such a way that they work together with the lateral edges (10) of the function carrier (1). Furthermore, there is a nose (28) that is supported on the tab (11) and creates a fail-safe (prevents drawer from falling out unintentionally) device, that is described further down.

Figure 11:
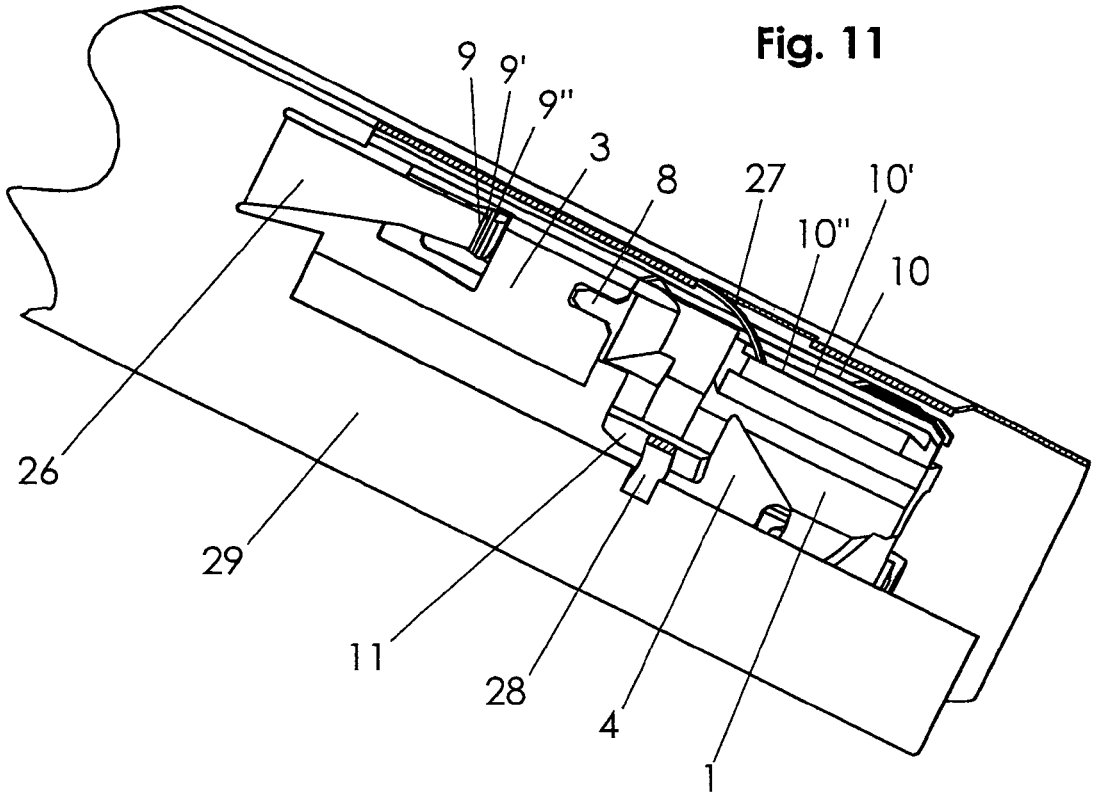
FIG. 11: a perspective view (partly in the profile/lengthwise section) of an embodiment example of the function carrier for a pull-out slide, which shows the function carrier with the attached decoration.

FIG. 11 shows a perspective view (partly lengthwise section) in which the decoration (29) is set on the pull-out slide (2) and/or the function carrier (1). The pull-out slide (2) and/or the function carrier (1) now lie inside the hollow space of the decoration (29). One recognizes that the end of the springy latch (26) is supported on the step-shaped bearing surfaces (9, 9' and/or 9"). Thus, a longitudinal fastening of the decoration (29) on the function carrier (1) is guaranteed. The bearing surfaces (9, 9' and 9") result in different catch positions for the springy latches (26, 26') so that the decoration (29) can be positioned in the longitudinal direction.

Furthermore, one recognizes that the detent grip claw (27) is supported on a lateral edge (10, 10' and/or 10"), so that the step-shaped form of the edges (10, 10', 10") make the securing of the decoration (29) in transverse direction various catch positions possible. In the lower area, the nose (28) is shown that lies on the tab (11) and, together with the detent grip claw (27), secures the decorations (29) in the up and down direction.

FIGS. 12 to 15 show embodiment examples for various positions of the decoration's (29) side centering in relation to the function carrier (1) and/or the pull-out slide (2). One recognizes the suggestion that the drawer bottom (37) as well as the drawer front (38), rest against the function carrier (1) of both pull-out slides (2). One recognizes the respective decoration (29) on the left and right side, its springy latches (26 and/or 26') that lie on the bearing surfaces (9) of the function carrier (1). The bearing surfaces (9, 9', 9") are step-shaped, so that a lengthwise equalization of the attachment of the decoration (29) is possible on the function carrier (1). By means of both latches (26 and 26'), the decoration (29) is laterally centered in relation to the function carrier (1).

Figure 12:
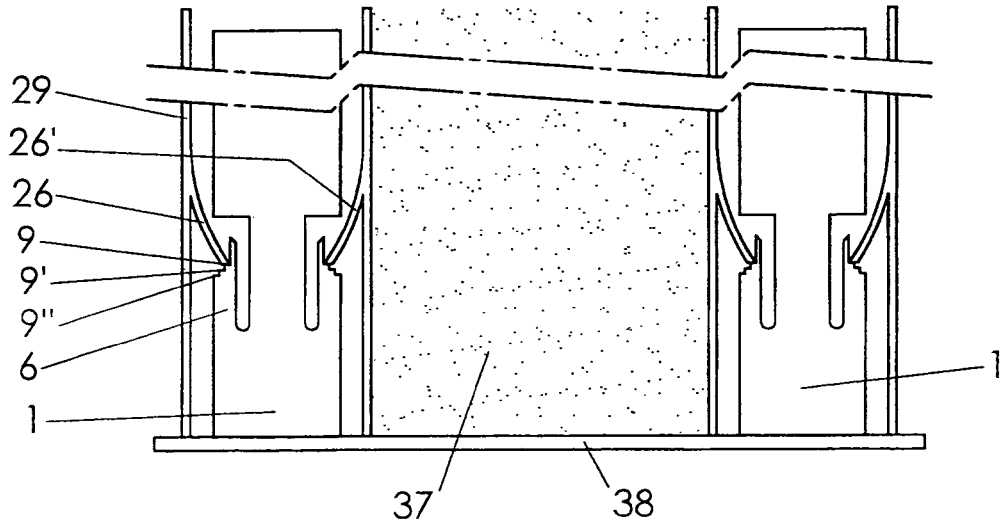
FIG. 12: a sketched view of a drawer, which shows a first position of the side centering of the decoration.

FIG. 12 shows a first position of the side centering with the springy latches (26, 26') engaging on the most inner and back step (9); whereby, the drawer bottom (37) has its target width, so that the function carrier (1) is centered exactly in the center of the decoration (29).

Figure 13:
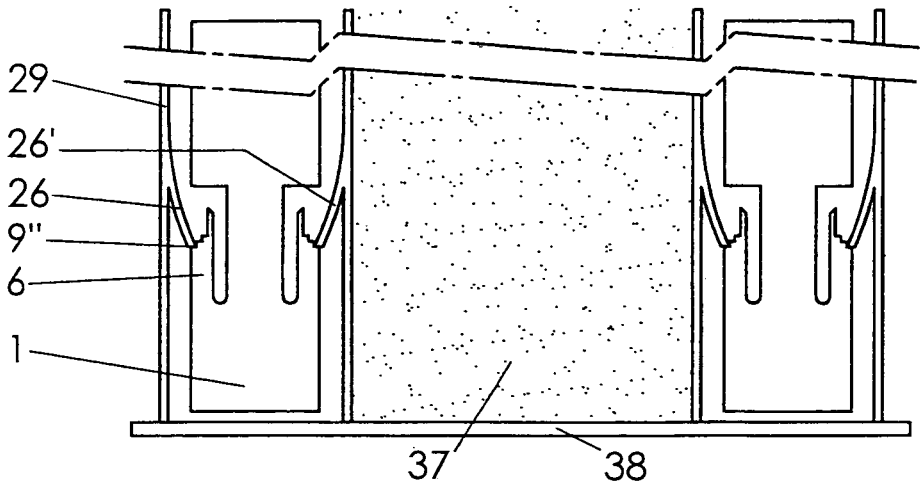
FIG. 13: a sketched view of a drawer, which shows a second position of the side centering of the decoration.

FIG. 13 shows a second position of the side centering; whereby, the latches (26, 26') engage into the upper, first step (9"). Here, a centering of the function carrier (1) is also shown somewhat forward opposite the decoration (29); whereby, the side centering is exactly centric.

The difference between the positioning of the decoration (29) on the step (9), according to FIG. 12, and the step (9"), according to FIG. 13 is that the depth of the drawer front is adjusted differently in relation to the cabinet body. So, in this manner, especially with several drawers, all drawer fronts are on one level with the cabinet body.

Figure 14:
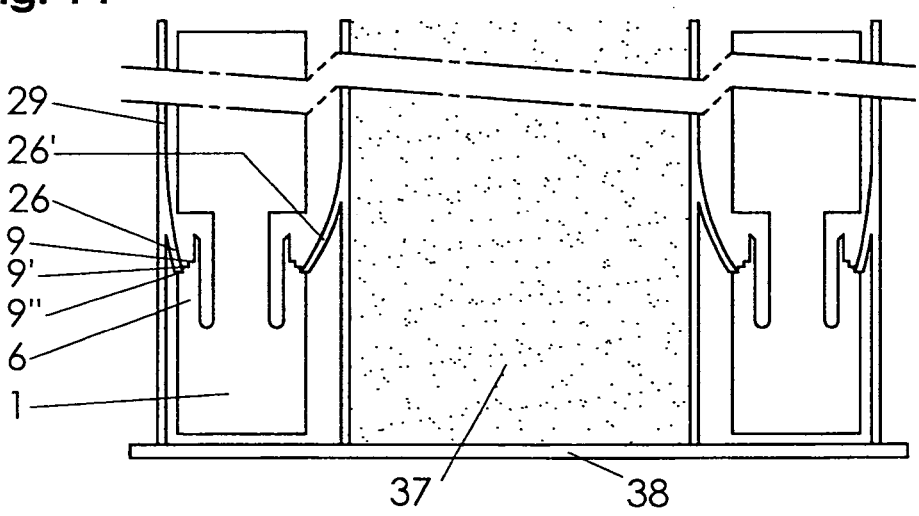
FIG. 14: a sketched view of a drawer, which shows a third position of the side centering of the decoration.

FIG. 14 shows a third position of the side centering; whereby, the drawer bottom (37) is made too wide, so that the function carrier (1) is not always centrically located, but instead, is located in an outward direction inside the decoration (29). Due to the length of the drawer, the latches (26) engage at the foremost step (9").

Figure 15:
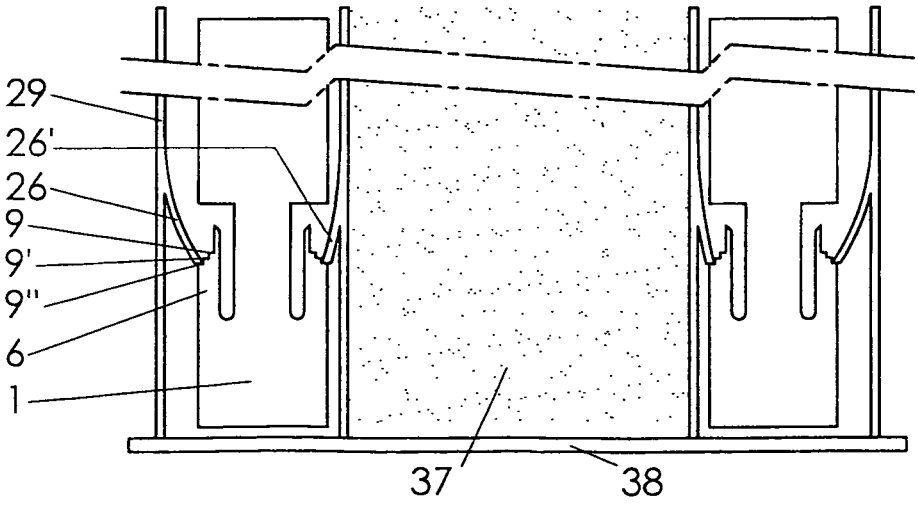
FIG. 15: a sketched view of a drawer, which shows a fourth position of the side centering of the decoration.

Finally FIG. 15 shows a fourth position of the side centering; whereby, the drawer bottom (37) is designed too small, so that the function carriers (1) are centered on the inner side of the decoration (29). The latches engage here also on the outermost step (9").

Figure 16:
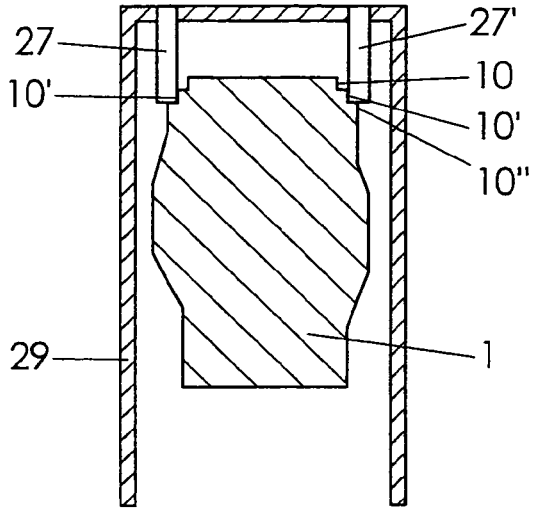
FIG. 16: a sketched cross-section through an embodiment example of the function carrier and the decoration, which shows a first position of the detent grip claws.
Figure 17:
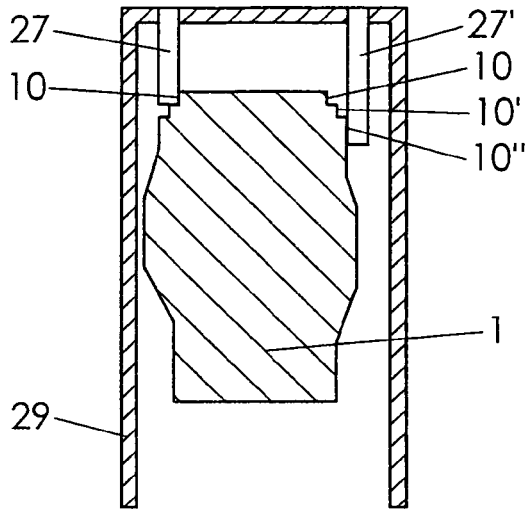
FIG. 17: a sketched view through an embodiment example of the function carrier and the decoration, which shows a second position of the detent grip claws.
Figure 18:
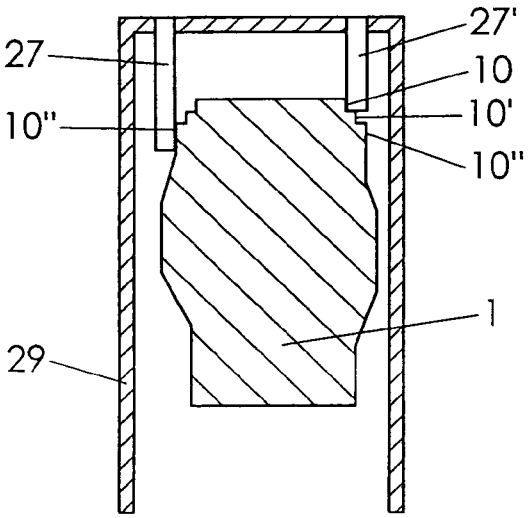
FIG. 18: a sketched view through an embodiment example of the function carrier and the decoration, which shows a third position of the detent grip claws.

FIGS. 16, 17 and 18 show the function of the detent grip claws (27, 27') working together with the edges (10, 10' and 10").

FIG. 16 corresponds to the installed position of the decoration (29) according to FIG. 13—that is, the decoration (29) is centered exactly in the middle over the function carrier (1). Here, both detent grip claws (27, 27') engage, for example, in the lowest step (10") of the edges.

FIG. 17 shows the situation according to FIG. 14 (for the left side of the drawer), that is, the decoration (29) is not centered in relation to the function carrier (1). Therefore, the springy detent grip claw (27) engages at the upper step (10), while detent grip claw (27') keeps the function carrier (1) lateral and fits on the step (10").

FIG. 18 shows the situation according to FIG. 15 (for the left side of the drawer)—that is, the decoration (29) is transferred outwardly in relation to the function carrier (1), so that the detent grip claw (27) engages at the lowest step (10") while the detent grip claw (27') lies on the uppermost step (10). As a result of the springy latches (26, 26') and the detent grip claws (27, 27') and the corresponding bearing surfaces (9, 9', 9") and edges (10, 10', 10") working together, the independent centering, adjustment and locking of the decoration (29) on the function carrier (1) and/or the drawer rail (3) are guaranteed.

Figure 19:
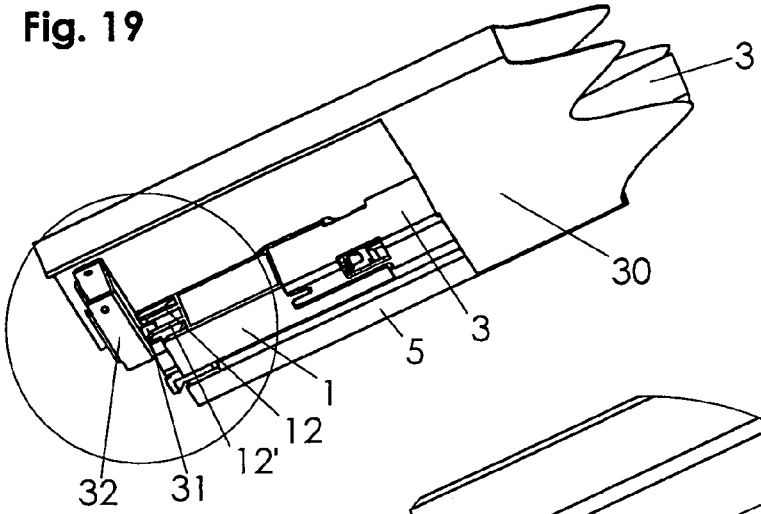
FIG. 19: a perspective view (partly sectional) of an embodiment example, which shows the function carrier in the pull-out slide with the drawer side wall.
Figure 20:
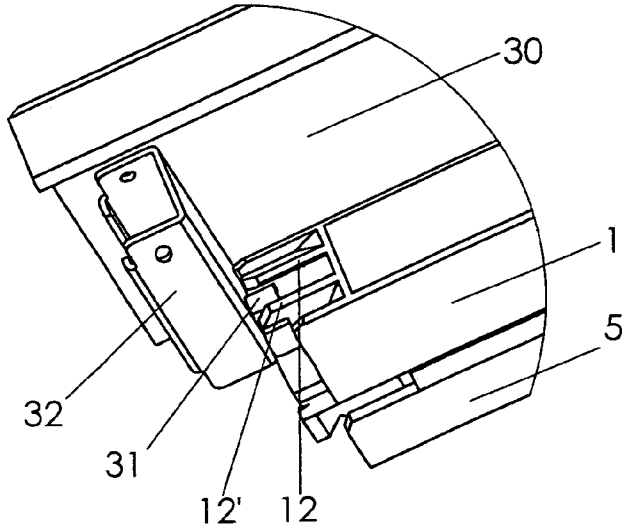
FIG. 20: a detailed view of FIG. 19, which shows the function for removing the drawer out of the pull-out slide.
Figure 21:
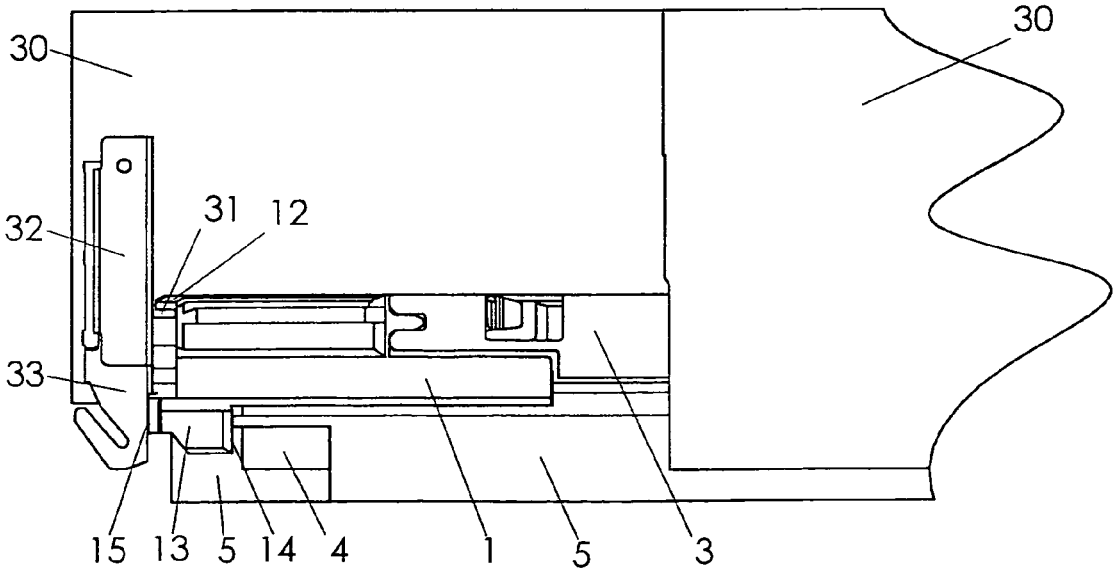
FIG. 21: a side view, partly cut, of an embodiment example of a function carrier for pull-out slides, which shows the function carrier in the pull-out slide together with the drawer side wall.

FIGS. 19, 20 and 21 show an embodiment example of the fastening of the drawer and/or drawer side wall (30) on the function carrier (1) and, thus, on the drawer rail (3).

As shown in FIG. 20 in detail, a fastening component (32) is connected on the drawer side wall (30), which has a peg and/or finger (31) in the direction of the function carrier (1). On the side of the function carrier (1), this finger is held laterally and upwardly by two springy tabs (12 and 12') and, so securely holds the drawer side wall (30) to the pull-out slide (2). The springy tabs (12, 12') give way upwards, so that if the drawer is pulled out, the finger (31) can be lifted out upward from the engagement with the springy tabs (12, 12') and the drawer is then disengaged from the drawer rail (3) and can be removed.

In FIG. 21 one recognizes the hook-shaped front fastening device (33) on which the drawer front (38) is then fastened.

In FIGS. 22, 23 and 24, the end stop (13) is more closely shown and described. The end stop (13) is on the underside of the function carrier (1) and includes a stop surface (14), which stops at the end position at the cabinet rail (5) when the drawer is pushed in.

FIG. 23 shows a springy designed stop surface (16) while FIG. 24 shows an elastic stop surface in the form of an elastomer part (17). An elastic and/or springy form of the stop surface (14) provides for a quiet, noise-free closing of the drawer and a certain reduction of kinetic energy.

In a preferred embodiment of the invention according to FIGS. 25, 26 and 27, the stop surfaces of the end stop (13) can also be designed adjustable, so that the front gap—that is, the distance between the drawer front (38) and the drawer rail (3) and/or cabinet body is adjustable. FIG. 25 shows the stop surface as an adjustable wheel (18), that has diagonal steps and/or multi-level steps, so that each step corresponds to a certain adjusting distance.

FIG. 26 shows an adjustable end stop by means of a springy tongue (20) that can be changed in its position by means of an adjusting screw (19). FIG. 27 shows an adjustable end stop by means of a knurled thumb screw (21), whose thread (22) sits in the end stop (13). The loosening, according to FIGS. 25 and 27, can be accomplished manually without tools, while the loosening, according to FIG. 26, requires a screwdriver.

Finally, FIGS. 28, 29 and 30 show the function and use of the hollow space (23) that is provided in the function carrier (1).

The hollow space (23) can, for example, be used to integrate a damping device (39), which absorbs the impact energy when the drawer is slammed shut. The energy is absorbed in the damping device (39) by means of a movable piston (40). The damping device (39) is pushed into the hollow space (23) and catches at the front side and/or on the back side by means of corresponding spring tongues (41, 42, 43), which work together with catch edges of the function carrier (1) and is, thus, engaged in function carrier (1). The damping device (39) is fixed in such a manner in the function carrier, that it supports its bottom on parts (32) of the drawer side wall (30) and so that the drawer energy is led directly on the piston rod (40).

DRAWING LEGEND

1. Function carrier
2. Pull-out slide
3. Drawer rail
4. Center rail
5. Cabinet rail
6. Springy latch→6, 6'
7. Step→7, 7'
8. Positioning element→8, 8'
9. Bearing surface→9, 9', 9"
10. Lateral edge→10, 10', 10"
11. Tab
12. Tab→12, 12'
13. End stop
14. Stop surface
15. Front surface of end stop
16. Springy stop surface
17. Elastomer part
18. Multi-level wheel
19. Screw
20. Tongue
21. Knurled thumb screw
22. Thread
23. Hollow space
24. Catch edge
25. Slot
26. Springy latch→26, 26'
27. Detent grip claw→27, 27'
28. Nose
29. Decoration
30. Drawer side wall
31. Finger
32. Part connected to the drawer side wall
33. Front fastening device
34. Damping element
35. Bottom of damping element
36. Cabinet adaptor

37. Drawer bottom
38. Drawer front
39. Damping element
40. Piston rod
41. Spring tongue
42. Spring tongue
43. Spring tongue
44. Opening (drawer rail)

What is claimed is:

1. A pull-out slide for a cabinet drawer having a drawer side wall, the pull-out slide comprising:

at least one elongate drawer rail with opposing front and rear ends that is fastenable to the drawer and that has portions defining an interior cavity of the drawer rail at the front end of the drawer rail;

a cabinet rail that is fastenable to a cabinet body, wherein the drawer rail is moveable between open and closed positions relative to the cabinet rail;

means cooperating with the drawer rail and the cabinet rail to enable a pull-out function of the drawer, wherein said cooperating means further comprises an elongate function carrier received within said interior cavity of the drawer rail and forming a lengthwise extension of the drawer rail proximate a front of the drawer, said function carrier having a function element for at least one of receiving drawer parts, holding drawer parts, connecting drawer parts, readying drawer functions, supporting drawer functions, and completing drawer functions; and a holding device engageable with a damping element or an automatic self-closing device, wherein the holding device is provided in the function carrier or on the function carrier, wherein the function carrier comprises portions defining a hollow space, distinct from the holding device, in which one of (a) a damping element and (b) an automatic self-closing device is received.

2. The pull-out slide according to claim 1, wherein the function carrier is releaseably attachable to the drawer rail.

3. The pull-out slide according to claim 2, further comprising a positioning element of the function carrier which engages a positioning element of the drawer rail for positioning the function carrier relative to the drawer rail upon attachment of the function carrier to the drawer rail.

4. The pull-out slide according to claim 1, wherein the function carrier is an integral component of the drawer rail.

5. The pull-out slide according to claim 1, further comprising at least one elastic springy latch that is formed on the function carrier and that engages into a corresponding opening of the drawer rail.

6. The pull-out slide according to claim 5, wherein the at least one springy latch of the function carrier has a step which is engageable with an edge of the opening of the drawer rail.

7. The pull-out slide according to claim 5, wherein the at least one springy latch of the function carrier is operable for releasing the function carrier from the drawer rail.

8. The pull-out slide according to claim 1, wherein the function carrier further comprises at least one device operable to releaseably connect at least one of a side wall of the drawer and a decoration component of the drawer to the drawer rail.

9. The pull-out slide according to claim 8, wherein the function carrier further comprises at least one bearing surface on at least one side of the function carrier which works together with at least one springy latch located on the decoration component of the drawer, whereby the at least one springy latch of the decoration component engages the at least one bearing surface on the at least one side of the function carrier and locks the decoration component to the function carrier against movement of the decoration component relative to the function carrier in a lengthwise direction of the function carrier.

10. The pull-out slide according to claim 9, wherein the at least one bearing surface further comprises a plurality of bearing surfaces that are formed step-like, defining a plurality of catch positions for engagement by the at least one springy latch of the decoration component, resulting in securing the decoration component against movement relative to the drawer rail in a lengthwise direction of the drawer rail.

11. The pull-out slide according to claim 8, further comprising a lateral edge of the function carrier that runs in the lengthwise direction along the function carrier which is engageable by a plurality of detent grip claws that are attached on the decoration component.

12. The pull-out slide according to claim 11, wherein the lateral edge that runs in the lengthwise direction along the function carrier is formed step-like to define a plurality of catch positions for the plurality of detent grip claws of the decoration component in order to secure the decoration component to the drawer rail in a transverse direction of the drawer rail.

13. The pull-out slide according to claim 1, further comprising a nose of a decoration component that is supported on a first springy tab of the function carrier and which blocks the first springy tab of the function carrier in the closed position of the drawer rail, thereby preventing the drawer from falling out of a drawer opening of a cabinet.

14. The pull-out slide according to claim 1, further comprising at least one finger on a fastening component configured to be positioned on a drawer side wall, the at least one finger being engageable with at least one springy tab disposed on the function carrier and configured to be disengageable from the at least one springy tab by lifting a drawer from the drawer rail.

15. The pull-out slide according to claim 1, further comprising an end stop that is attached to an underside of the function carrier which meets with an end position on the cabinet rail.

16. Pull-out slide, according to claim 15 wherein the stop surface is formed one of (a) flexible and elastic and (b) includes one of an inserted and an attached flexible elastic part.

17. The pull-out slide according to claim 15, wherein the end stop comprises a stop surface located either (a) at an adjustable element or (b) on an adjustable element.

18. Pull-out slide, according to claim 17, wherein the adjustable element is formed as a multi-level wheel located on the function carrier.

19. Pull-out slide, according to claim 17, wherein the adjustable element is designed as an adjusting screw activating a spring tongue of the stop surface.

20. The pull-out slide according to claim 17, wherein the adjustable element is designed as a knurled thumb screw.

21. The pull-out slide according to claim 15, wherein a front surface of the end stop is supported directly on one of (a) a decoration component and (b) a front fastening device.

22. The pull-out slide according to claim 1, wherein the holding device is engageable with one of the damping element or the automatic self-closing device such that said one of the damping element or the automatic self-closing device is arranged with a bottom of said one of the damping element or the automatic self-closing device configured to be supported on a part of a drawer side wall.

23. A pull-out slide for a cabinet drawer having a drawer side wall, the pull-out slide comprising:

at least one elongate drawer rail with opposing front and rear ends that is fastenable to the drawer and that has portions defining an interior cavity of the drawer rail at the front end of the drawer rail;

a cabinet rail that is fastenable to a cabinet body, wherein the drawer rail is moveable between open and closed positions relative to the cabinet rail;

means cooperating with the drawer rail and the cabinet rail to enable a pull-out function of the drawer, wherein said cooperating means further comprises an elongate function carrier received within said interior cavity of the drawer rail and forming a lengthwise extension of the drawer rail proximate a front of the drawer, said function carrier having a function element for at least one of receiving drawer parts, holding drawer parts, connecting drawer parts, readying drawer functions, supporting drawer functions, and completing drawer functions;

a holding device provided in the function carrier or on the function carrier; and a damping element engaged by the holding device.

24. A pull-out slide for a cabinet drawer having a drawer side wall, the pull-out slide comprising:

at least one elongate drawer rail with opposing front and rear ends that is fastenable to the drawer and that has portions defining an interior cavity of the drawer rail at the front end of the drawer rail;

a cabinet rail that is fastenable to a cabinet body wherein the drawer rail is moveable between open and closed positions relative to the cabinet rail;

means cooperating with the drawer rail and the cabinet rail to enable a pull-out function of the drawer, wherein said cooperating means further comprises an elongate function carrier received within said interior cavity of the drawer rail and forming a lengthwise extension of the drawer rail proximate a front of the drawer, said function carrier having a function element for at least one of receiving drawer parts, holding drawer parts, connecting drawer parts, readying drawer functions, supporting drawer functions, and completing drawer functions;

a holding device provided in the function carrier or on the function carrier; and an automatic self-closing device engaged by the holding device.

* * * * *

UNITED STATES PATENT AND TRADEMARK OFFICE

CERTIFICATE OF CORRECTION

PATENT NO. : 7,654,625 B2
APPLICATION NO. : 10/858609
DATED : February 2, 2010
INVENTOR(S) : Amann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 547 days.

Signed and Sealed this

Twenty-eighth Day of December, 2010

David J. Kappos

David J. Kappos
*Director of the United States Patent and Trademark Office*